US007481715B2

(12) United States Patent
Byrne

(10) Patent No.: US 7,481,715 B2
(45) Date of Patent: Jan. 27, 2009

(54) GOLF CLUB HEAD WITH ALIGNMENT LINE

(75) Inventor: Wayne H. Byrne, Murrieta, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/694,724

(22) Filed: Mar. 30, 2007

(65) Prior Publication Data

US 2007/0232409 A1 Oct. 4, 2007

Related U.S. Application Data

(60) Provisional application No. 60/744,040, filed on Mar. 31, 2006.

(51) Int. Cl.
*A63B 69/36* (2006.01)
*A63B 53/04* (2006.01)

(52) U.S. Cl. ..... 473/231; 473/238; 473/242; 473/244

(58) Field of Classification Search ..... 473/238, 473/242, 244, 252, 340, 231, 345–346, 251; D21/742, 746, 759, 733
See application file for complete search history.

(56) References Cited

U.S. PATENT DOCUMENTS 1,291,967 A * 1/1919 McDougal ..... 473/251
1,435,318 A * 11/1922 Mattern ..... 473/342
2,003,951 A * 6/1935 Pepin ..... 473/242
2,520,950 A * 9/1950 Miller ..... 473/242
2,842,369 A * 7/1958 East ..... 473/242
2,865,635 A * 12/1958 Jessen ..... 473/201
4,458,900 A 7/1984 Antonious
4,960,279 A * 10/1990 Harris, Jr. ..... 473/251
D366,682 S * 1/1996 Antonious ..... D21/752
5,632,695 A * 5/1997 Hlinka et al. ..... 473/341
5,720,668 A 2/1998 Brett
D429,785 S * 8/2000 Leysock ..... D21/742
6,435,980 B1 * 8/2002 Reyes et al. ..... 473/324
6,582,322 B2 6/2003 Long et al.
6,605,006 B2 8/2003 Mason
6,729,967 B2 * 5/2004 Ford ..... 473/242
D496,084 S * 9/2004 Imamoto ..... D21/759
7,077,757 B1 7/2006 Payne et al.

* cited by examiner

*Primary Examiner*—Sebastiano Passaniti
(74) *Attorney, Agent, or Firm*—Michael A. Catania; Elaine H. Lo

(57) ABSTRACT

A golf club having a golf club head with an alignment line that makes the actual face angle of the golf club appear differently when the golf club is at address. The golf club head preferably has a white line at a face-crown junction which changes the appearance of the face angle while the golf club is at address. The golf club head is preferably a driver or fairway wood, and preferably has a volume of 250 cubic centimeters to 475 cubic centimeters.

1 Claim, 7 Drawing Sheets

GOLF CLUB HEAD WITH ALIGNMENT LINE

CROSS REFERENCES TO RELATED APPLICATIONS

The Present Application claims priority to U.S. Provisional Patent Application No. 60/744,040, filed on Mar. 31, 2006.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with an alignment line. More specifically, the present invention relates to a wood-type golf club head with an alignment line on the crown.

2. Description of the Related Art

Appearance is everything. This is especially true when it comes to the appearance of a golf club at address. If a golf club appears to have an open face angle, then a golfer will believe that it is open and swing accordingly. If a golf club appears to have a closed face angle, then a golfer will believe that it is closed and swing accordingly.

The face angle of a golf club is defined as the angle of the face to the grounded sole line with the shaft hole perpendicular to the line of flight. Maltby, *Golf Club Design, Fitting, Alteration*, & *Repair, The Principles* & *Procedures,* $4^{th}$ Edition, Ralph Maltby Enterprises, (1995).

BRIEF SUMMARY OF THE INVENTION

The present invention allows for a golf club head with an alignment line that affects the appearance of the face angle of the golf club. For example, the golf club has a closed face angle, however, the alignment line provides the appearance at address of a golf club with an open face angle.

One aspect of the present invention is a wood-type golf club head. The golf club head includes a body and an alignment line. The body has a front portion, a crown portion and a sole portion. The body also has a heel end, a toe end and an aft end. The crown portion has a first color. The alignment line is disposed at a junction of the crown portion and the front portion. The alignment line extends from a heel end to a toe end. The alignment line has a width ranging from 0.10 inch to 1.0 inch. The alignment line has a second color which is visually different from the first color.

Another aspect of the present invention is a wood-type golf club. The golf club includes a golf club head, an alignment line and a shaft. The golf club head includes a body having a front portion, a crown portion and a sole portion. The body also has a heel end, a toe end and an aft end. The crown portion has a first color. The alignment line is disposed at a junction of the crown portion and the front portion. The alignment line extends from a heel end to a toe end. The alignment line has a width ranging from 0.10 inch to 1.0 inch. The alignment line has a second color which is visually different from the first color. The shaft is connected to the golf club head. The alignment line provides the face angle appearance of one of the following at address of a golf ball, an appearance of an open or square face angle when the face angle is closed, an appearance of a closed or square face angle when the face angle is open, an appearance of an open face angle when the face angle is square, and an appearance of a closed face angle when the face angle is square.

The golf club head preferably has a volume ranging from 420 cc to 470 cc.

The second color of the alignment line is preferably white and the first color of the crown portion is preferably selected from the group consisting of black, grey, blue, brown and purple.

Another aspect of the present invention is a wood-type golf club head including a body and a white alignment line. The body has a front portion, a crown portion and a sole portion. The body also has a heel end, a toe end and an aft end. The crown portion has a color selected from the group consisting of black, grey, blue, brown and purple. The alignment line is disposed at a junction of the crown portion and the front portion. The alignment line extends from a heel end to a toe end. The alignment line has a width ranging from 0.10 inch to 1.0 inch.

The crown portion preferably has a first surface region and a second surface region. The first surface region has a surface area ranging from 2.5 square inches to 4.5 square inches. The second surface region preferably has a surface area ranging from 0.5 square inches to 1.5 square inches. The second surface region is the alignment line and the first surface region is the surface area of the crown portion not including the alignment line.

The golf club head can also include a second line perpendicular to the alignment line, and the second line preferably has a color similar to the alignment line.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
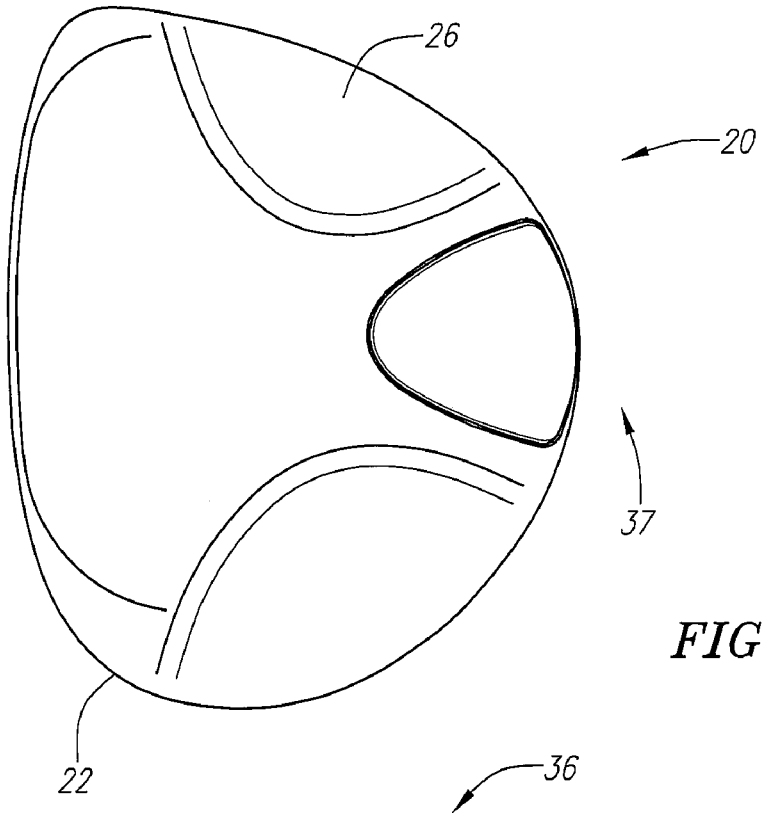
FIG. 1 is a bottom plan view of a golf club head.
Figure 2:
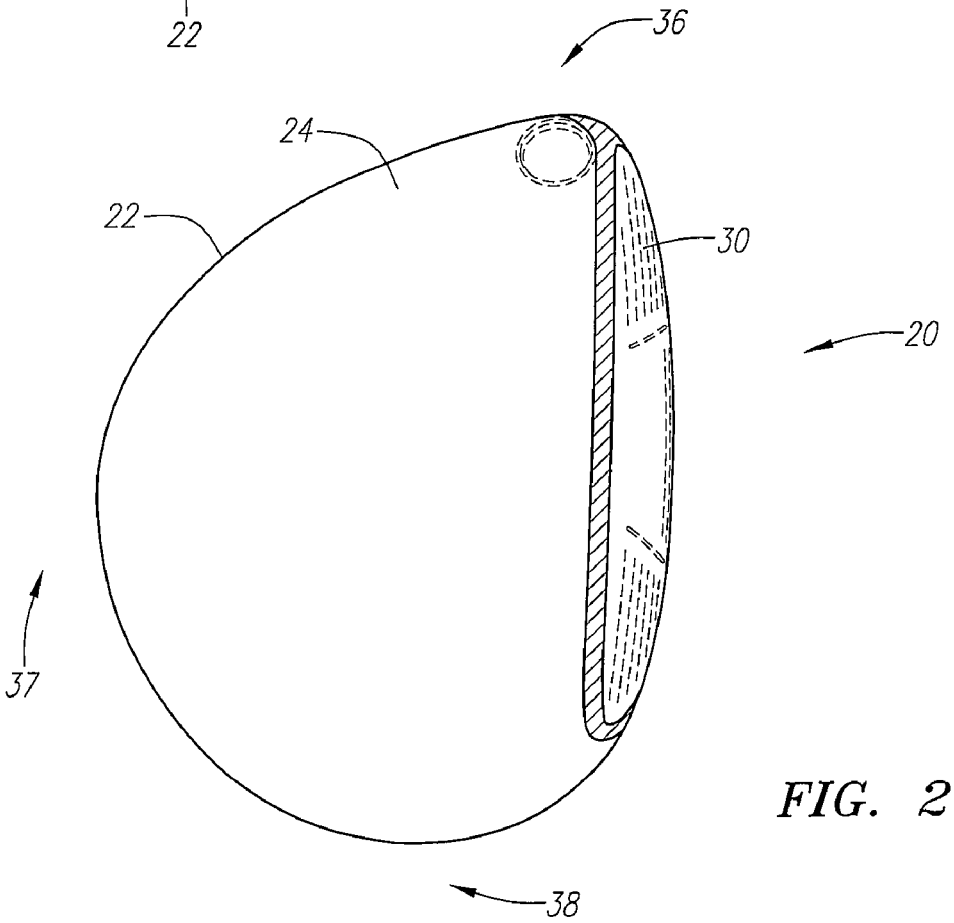
FIG. 2 is a top plan view of a golf club head.
Figure 3:
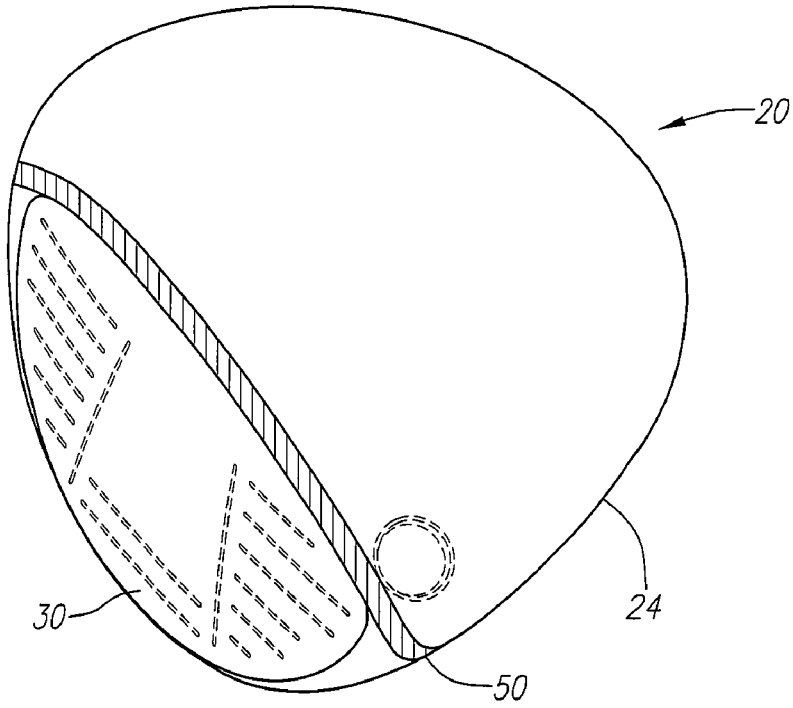
FIG. 3 is a top front perspective view of a golf club head.
Figure 4:
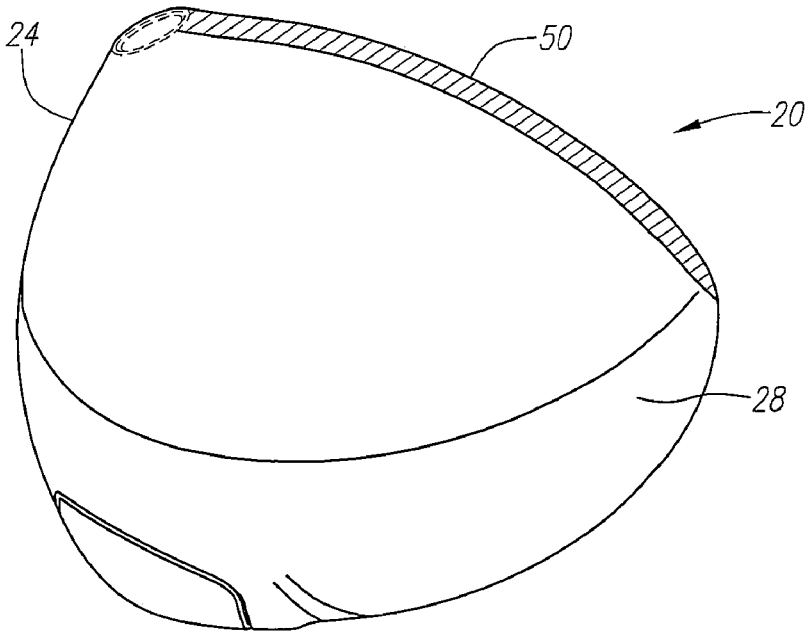
FIG. 4 is a top rear perspective view of a golf club head.
Figure 5:
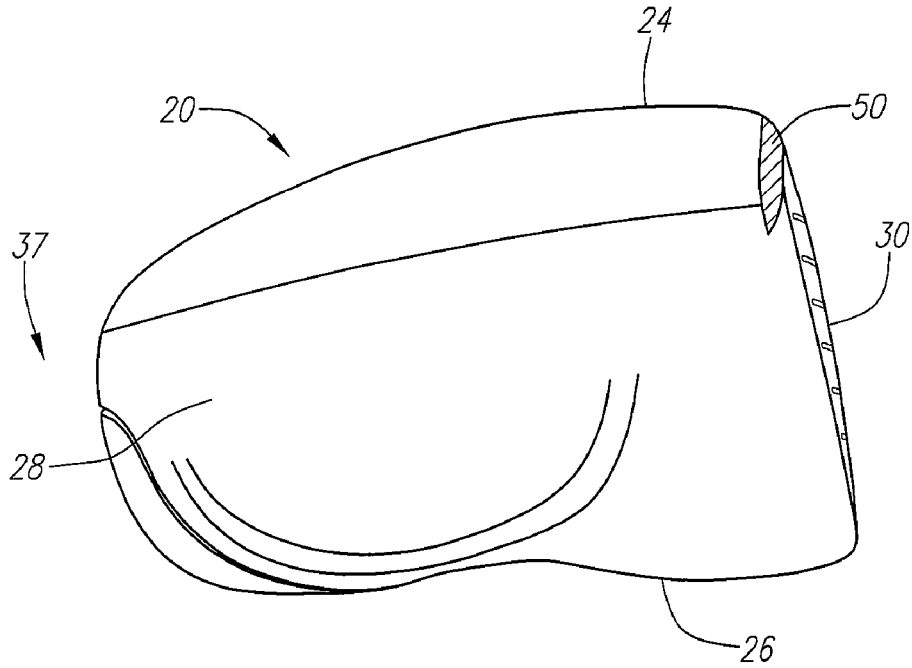
FIG. 5 is a toe side view of a golf club head.
Figure 6:
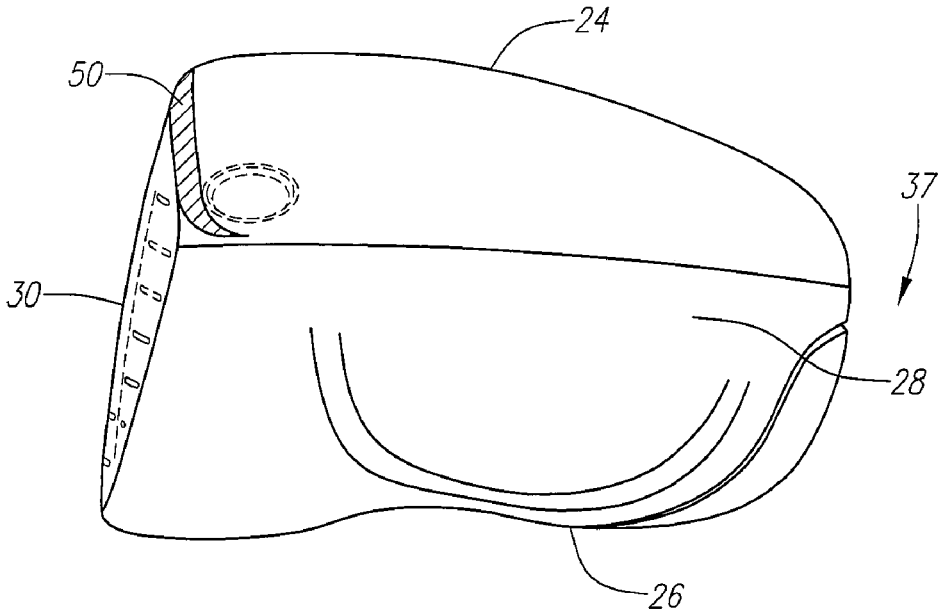
FIG. 6 is a heel side view of a golf club head.

As shown in FIGS. 1-6, a golf club head of the present invention is generally designated 20. The golf club head 20 has a body 22, which preferably includes a crown portion 24, a sole portion 26, a ribbon portion 28, a front wall 30 and a hollow interior. The golf club head 20 has a heel end 36, a toe end 38, and an aft end 37.

The golf club 20 has an alignment line 50 which is disposed at a junction 55 of the crown portion 24 and the front wall 30 in order to make the face angle of the golf club appear differently. The alignment line 50 can make a closed face angle appear open or square. Alternatively, the alignment line 50 can make an open face angle appear closed or square. Still, alternatively, the alignment line 50 can make a square face angle appear open or closed. In order to accomplish this, the alignment line 50 has a visual color that is different than the color of the crown portion 24. Typically, the crown portion 24 has a first color that is black, grey, blue, brown, purple or some other dark color. The alignment line 50 preferably has a color that is white or some other lighter color. However, those skilled in the pertinent art will recognize that the alignment line may be a dark color and the crown portion may be a light color.

The alignment line 50 preferably extends from the heel end 36 to the toe end 38. The alignment line 50 preferably has a width that ranges from 0.100 inch to the 1.0 inch.

In one embodiment, the crown portion 24 preferably has a first surface region and a second surface region with the first surface region having a surface area ranging from 2.5 square inches to 4.5 square inches and the second surface region having a surface area ranging from 0.5 square inches to 1.5 square inches. In this embodiment, the second surface region is the alignment line 50, and the first surface region is the non-alignment line portion of the crown portion 24.

The golf club head 20, when designed as a driver, preferably has a volume from 200 cubic centimeters to 600 cubic centimeters, more preferably from 300 cubic centimeters to 500 cubic centimeters, and most preferably from 350 cubic centimeters to 480 cubic centimeters. The volume of the golf club head 20 will also vary between fairway woods (preferably ranging from 3-woods to eleven woods) with smaller volumes than drivers. The golf club head 20 preferably has a mass no more than 225 grams, and most preferably a mass of 180 to 215 grams.

Preferably the golf club head 20 has a body 22 that is composed of titanium, titanium alloy, stainless steel or other iron-alloys. Alternatively, the body 22 may be composed of a lightweight metallic material, such as magnesium alloys, aluminum alloys, magnesium, aluminum or other low density metals.

Another embodiment of the golf club head 20 has a body 22 that is preferably composed of a plurality of plies of pre-preg, typically six or seven plies (preferably ranging from three plies to twenty plies) such as disclosed in U.S. Pat. No. 6,248,025, entitled Composite Golf Head And Method Of Manufacturing, which is hereby incorporated by reference in its entirety.

Another embodiment of the golf club head 20 is disclosed in U.S. Pat. No. 6,565,452, for a Multiple Material Golf Club Head with Face Insert, filed on Feb. 28, 2002, and is hereby incorporated by reference in its entirety.

Figure 7:
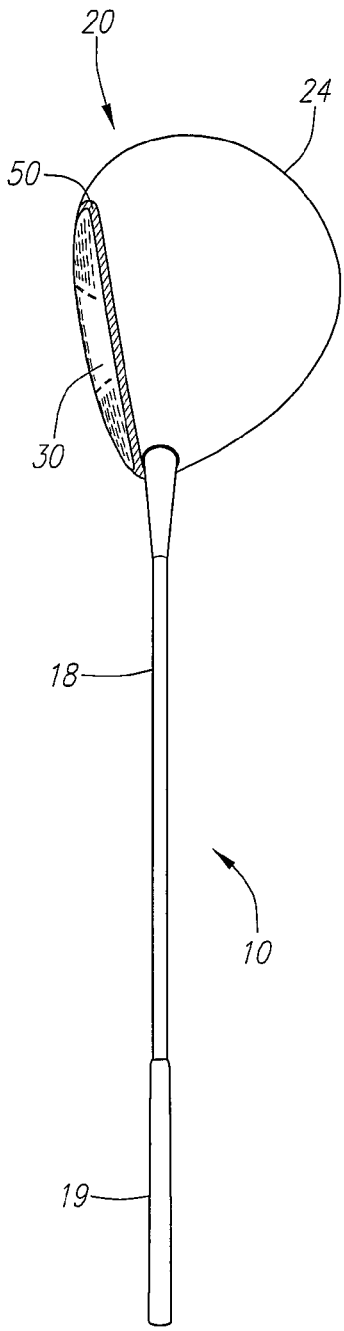
FIG. 7 is a top view of a golf club at address with the golf club having a closed face angle.
Figure 8:
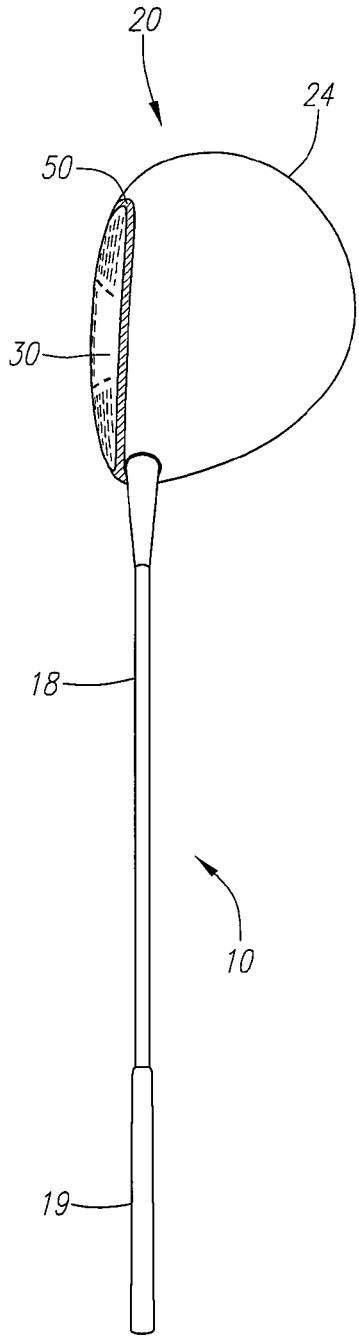
FIG. 8 is a top view of a golf club at address with the golf club having a square face angle.
Figure 9:
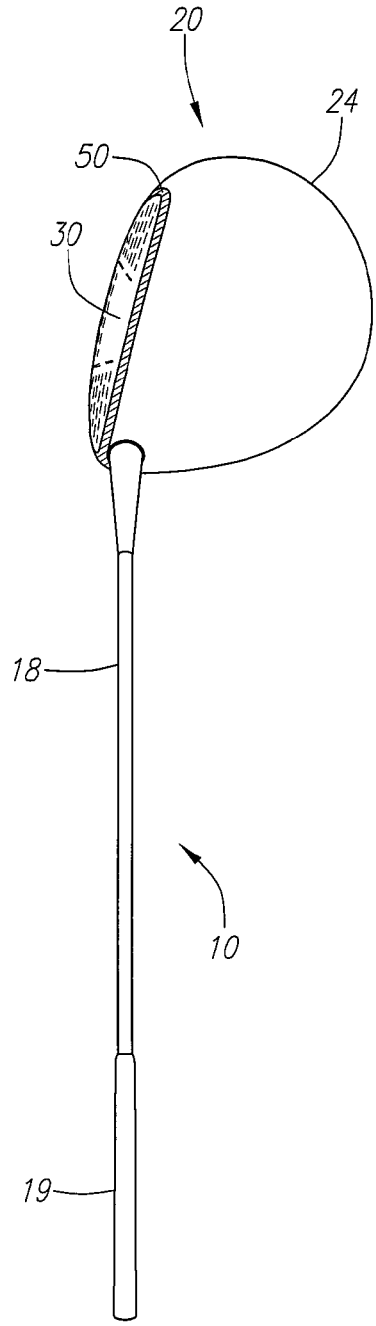
FIG. 9 is a top view of a golf club at address with the golf club having an open face angle.

FIG. 7 illustrates a golf club 10 with a closed face angle. The golf club 10 has a club head 20, a shaft 18 with a grip 19 attached at a butt end of the shaft 18. The alignment line 50 makes the face angle of the golf club 10 appear more open. FIG. 8 illustrates a golf club 10 with a square face angle, with the alignment line 50 making the face angle of the golf club appear more open. FIG. 9 is a golf club with an open face angle. The alignment line 50 makes the face angle of the golf club 10 appear more closed.

Figure 10:
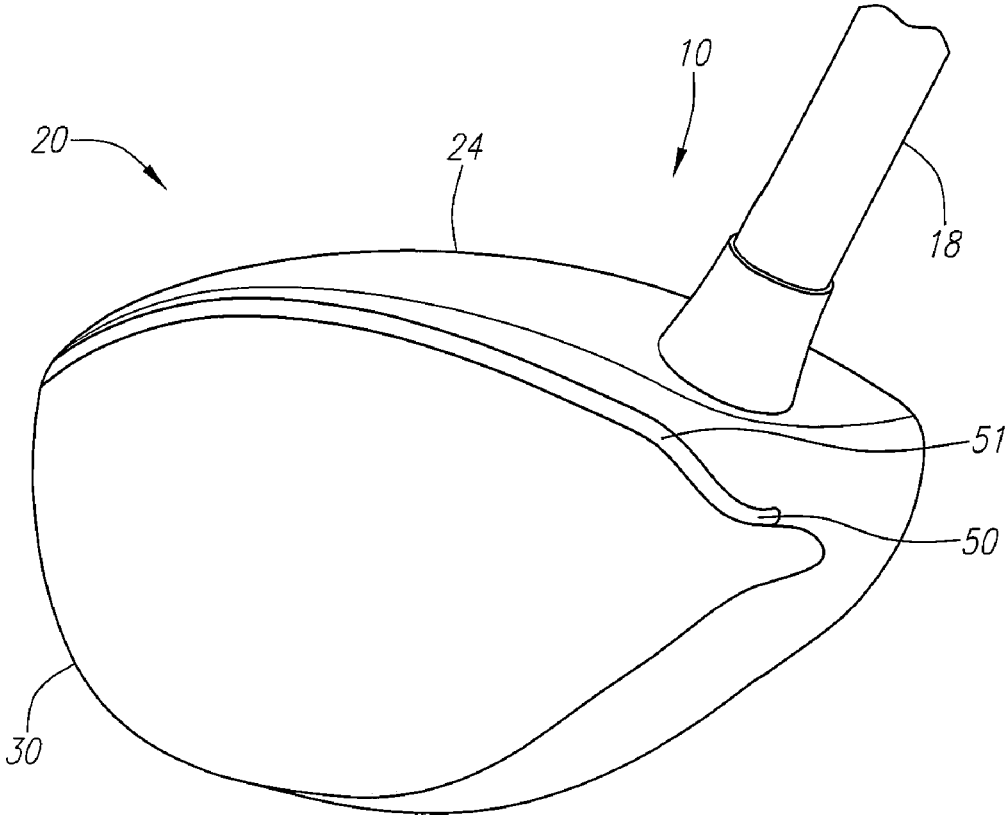
FIG. 10 is a front view of a golf club.
Figure 11:
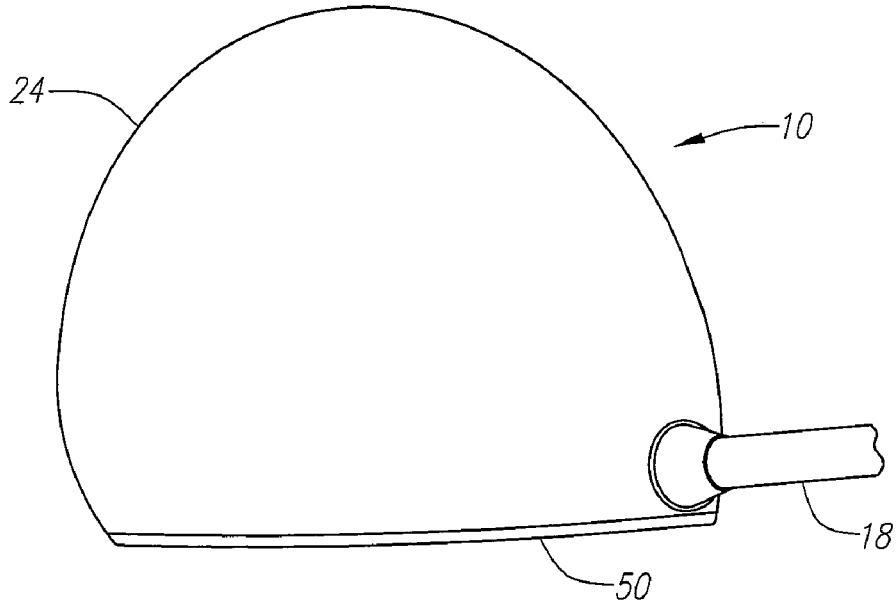
FIG. 11 is a top view of a golf club with an open face angle.
Figure 12:
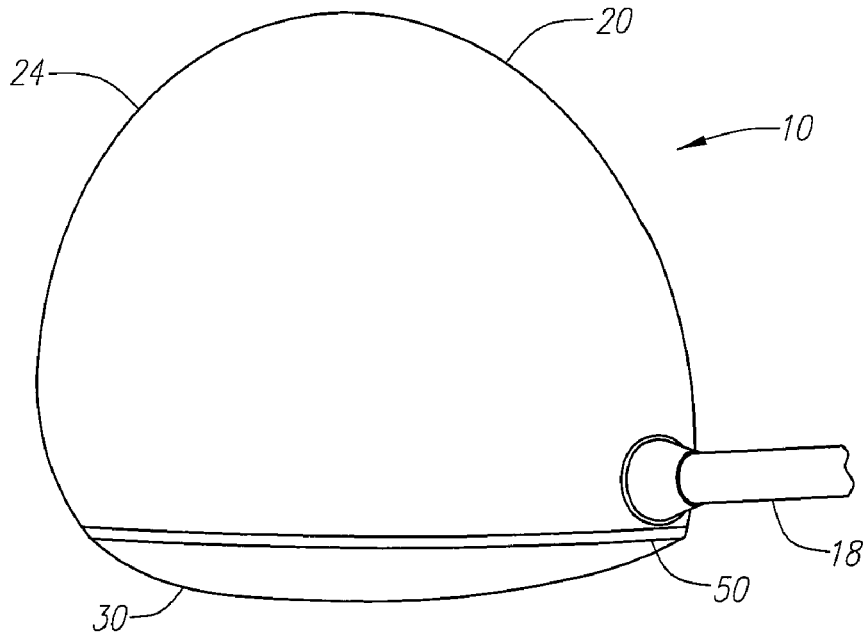
FIG. 12 is a top view of a golf club with a closed face angle.
Figure 13:
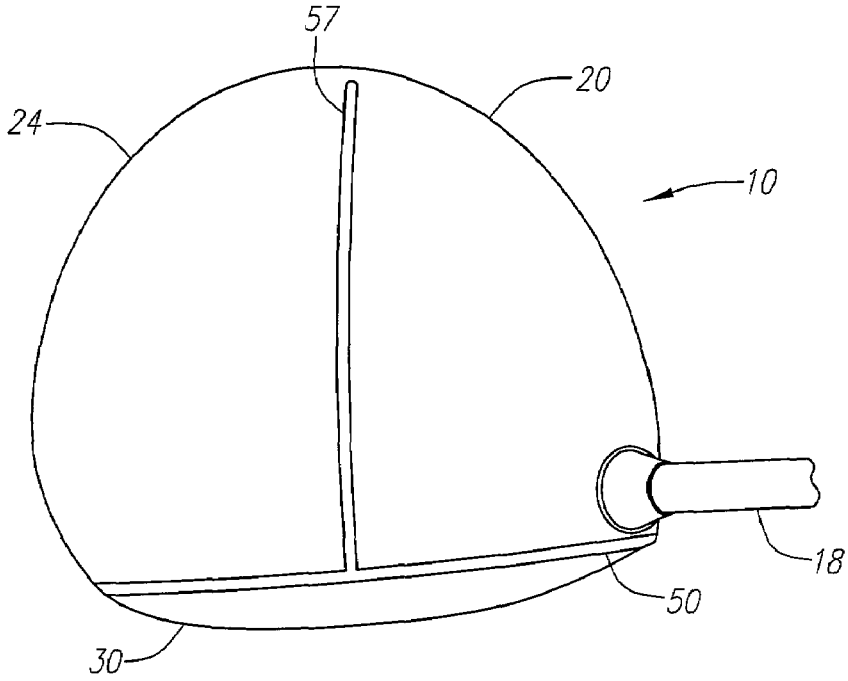
FIG. 13 is a top view of a golf club with a closed face angle and perpendicular alignment lines.
Figure 14:
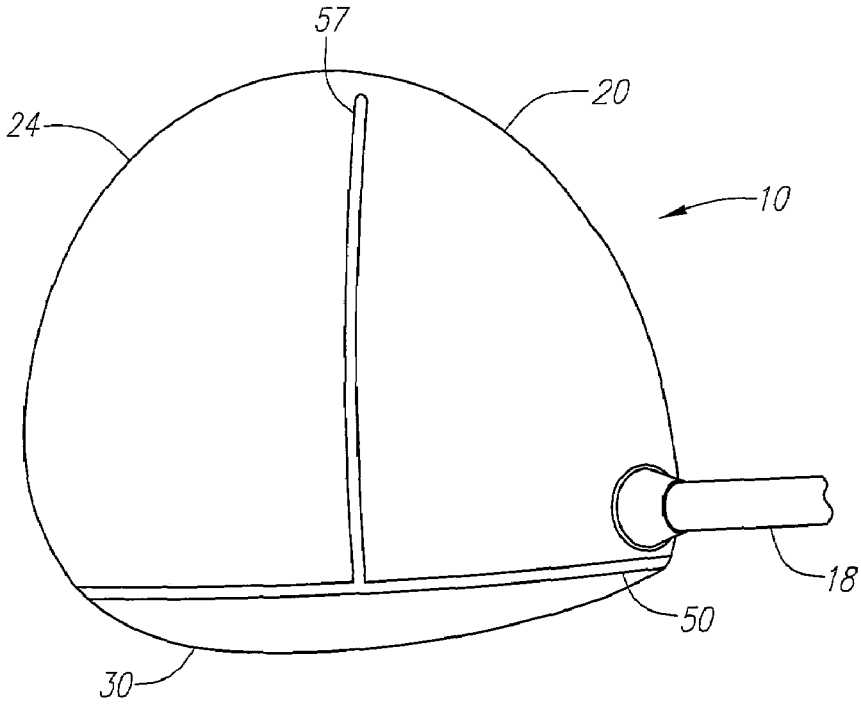
FIG. 14 is a top view of a golf club with a square face angle and perpendicular alignment lines.

FIG. 10 illustrates a golf club 10 with a white alignment line 50 at the junction 51. The crown portion 24 has a black color. FIG. 11 is a top view of a golf club 10 with an open face angle. The alignment line 50 makes the face angle of the golf club 10 appear more closed. FIG. 12 is a top view of a golf club 10 with a closed face angle. The alignment line 50 makes the face angle of the golf club 10 appear more open. FIG. 13 is a top view of a golf club 10 with a closed face angle. The golf club 10 has an alignment line 50 with a perpendicular alignment line 57. FIG. 14 is a top view of a golf club 10 with a square face angle. The golf club 10 has an alignment line 50 with a perpendicular alignment line 57.

In some embodiments, the heel end of the alignment line 50 has a greater width than the toe end. In other embodiments, the toe end of the alignment line 50 has a greater width than the heel end of the alignment line 50.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A wood-type golf club comprising:

a golf club head comprising a body having a front portion, a crown portion and a sole portion, the body also having a heel end, a toe end and an aft end, the crown portion having a first color, wherein the crown portion has a first surface region and a second surface region, the first surface region having a surface area ranging from 2.5 square inches to 4.5 square inches, the second surface region having a surface area ranging from 0.5 square inch to 1.5 square inches, an alignment line disposed at a junction of the crown portion and the front portion, the alignment line extending from a heel end of the crown portion to a toe end of the crown portion, the alignment line having a width ranging from 0.10 inch to 1.0 inch, wherein the second surface region of the crown portion is the alignment line and the first surface region of the crown portion is the surface area of the crown portion not including the alignment line, wherein the alignment line is white and the first color of the crown portion is visually different from the alignment line; and a shaft connected to the golf club head;

wherein the alignment line provides the face angle appearance of one of the following at address of a golf ball, an appearance of an open or square face angle when the actual face angle of the golf club head is closed, an appearance of a closed or square face angle when the actual face angle of the golf club head is open, an appearance of an open face angle when the actual face angle of the golf club head is square, and an appearance of a closed face angle when the actual face angle of the golf club head is square.

* * * * *